US009644836B1

(12) United States Patent
Field et al.

(10) Patent No.: US 9,644,836 B1
(45) Date of Patent: May 9, 2017

(54) LIGHTED HANDRAIL ASSEMBLY

(71) Applicant: Itasca Plastics Inc, St. Charles, IL (US)

(72) Inventors: Eric A. Field, Wheaton, IL (US); Matthew W. Field, Wheaton, IL (US)

(73) Assignee: Itasca Plastics, Inc, St. Charles, IL (US)

( * ) Notice: Subject to any disclaimer, the term of this patent is extended or adjusted under 35 U.S.C. 154(b) by 20 days.

(21) Appl. No.: 14/673,079

(22) Filed: Mar. 30, 2015

Related U.S. Application Data

(60) Provisional application No. 61/971,611, filed on Mar. 28, 2014, provisional application No. 61/971,625, filed on Mar. 28, 2014.

(51) Int. Cl.

| | |
|---|---|
| ***F21V 33/00*** | (2006.01) |
| ***E04F 19/02*** | (2006.01) |
| ***E04F 11/18*** | (2006.01) |
| ***F21V 23/06*** | (2006.01) |
| ***F21K 99/00*** | (2016.01) |
| ***F21V 5/04*** | (2006.01) |
| *F21W 111/08* | (2006.01) |
| *F21Y 101/02* | (2006.01) |

(52) U.S. Cl.
CPC ..... *F21V 33/006* (2013.01); *E04F 11/1802* (2013.01); *E04F 19/026* (2013.01); *F21K 9/50* (2013.01); *F21V 5/04* (2013.01); *F21V 23/06* (2013.01); *E04F 2011/1872* (2013.01); *F21W 2111/08* (2013.01); *F21Y 2101/02* (2013.01)

(58) Field of Classification Search
CPC ..... F21V 33/006; F21V 5/04; F21V 23/06; E04F 11/1802; E04F 19/026; E04F 2011/1872; F21K 9/50; F21W 2111/08; F21Y 2101/02
See application file for complete search history.

(56) References Cited

U.S. PATENT DOCUMENTS

| | | | | |
|---|---|---|---|---|
| 2,310,593 A | | 11/1941 | Orlicki | |
| 3,057,991 A | | 10/1962 | Grenadier | |
| 3,740,541 A | | 6/1973 | Conradt | |
| 3,813,071 A | | 5/1974 | Noryd | |
| 4,161,769 A | | 7/1979 | Elliott | |
| 4,367,517 A | * | 1/1983 | Balzer | E04F 11/1804 362/146 |
| 4,394,718 A | | 7/1983 | Balzer | |
| 4,413,311 A | | 11/1983 | Orenstein | |
| 5,099,402 A | | 3/1992 | Starniri | |
| 5,450,299 A | * | 9/1995 | Lepre | E04F 11/1804 362/145 |
| 5,592,786 A | | 1/1997 | Kamm | |
| 5,779,228 A | | 7/1998 | Hansen | |

(Continued)

*Primary Examiner* — Mary Ellen Bowman
(74) *Attorney, Agent, or Firm* — Erickson Law Group, PC

(57) ABSTRACT

A handrail system includes an elongated rail member, wherein the rail member includes a slot for carrying illumination elements, such as LED elements. The LED elements are provided in a light assembly that includes the LED's carried on a printed circuit board that is held by a lens member, the lens member being captured in the rail member slot. A cover the rail member can be co-extruded to have an opaque portion and a clear or translucent portion. The clear or translucent portion can overlie illumination elements. The opaque portion can cover the remainder of the rail member.

19 Claims, 8 Drawing Sheets

(56) References Cited

U.S. PATENT DOCUMENTS

| | | | | |
|---|---|---|---|---|
| 6,065,852 | A | 5/2000 | Crumley | |
| 6,074,074 | A * | 6/2000 | Marcus | B29C 45/14655 362/234 |
| 6,212,809 | B1 * | 4/2001 | Gaule | G09F 3/0295 40/660 |
| 6,425,676 | B1 | 7/2002 | Lyons | |
| 6,860,472 | B2 | 3/2005 | Striebel et al. | |
| 7,044,450 | B2 | 5/2006 | Striebel et al. | |
| 7,347,606 | B1 | 3/2008 | Patten | |
| 7,722,207 | B2 | 5/2010 | Bennette | |
| 7,815,389 | B2 | 10/2010 | Wagner et al. | |
| 8,002,426 | B2 | 8/2011 | Pearson et al. | |
| 8,123,373 | B2 | 2/2012 | Vogt et al. | |
| 8,210,705 | B2 * | 7/2012 | Pesson | E04F 11/1836 362/146 |
| 8,388,214 | B1 * | 3/2013 | Toro | F21V 33/006 362/147 |
| 8,393,457 | B2 | 3/2013 | Illedits et al. | |
| 9,206,953 | B2 * | 12/2015 | Roos | E04F 11/1817 |
| 2005/0270774 | A1 * | 12/2005 | Pan | F21V 5/02 362/217.12 |
| 2008/0080173 | A1 * | 4/2008 | Trimble | E04F 11/18 362/146 |
| 2008/0253112 | A1 * | 10/2008 | Nash | E04F 11/1804 362/147 |
| 2008/0304253 | A1 * | 12/2008 | Handsaker | B66B 23/24 362/146 |
| 2011/0090680 | A1 * | 4/2011 | Steinkraus | F21V 14/04 362/217.05 |
| 2012/0182721 | A1 | 7/2012 | Pesson et al. | |
| 2012/0212954 | A1 * | 8/2012 | Hirai | E04F 11/1836 362/223 |
| 2013/0279160 | A1 * | 10/2013 | Myers | F21K 9/50 362/224 |

* cited by examiner

FIG. 5
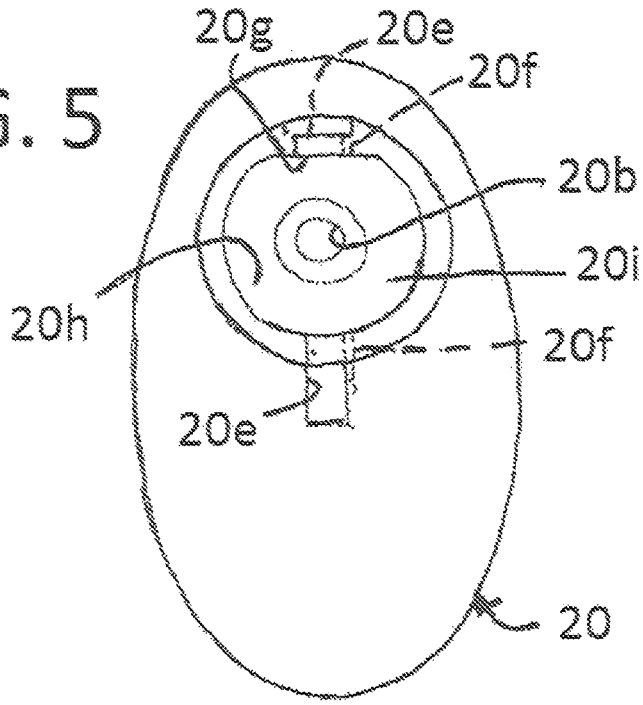
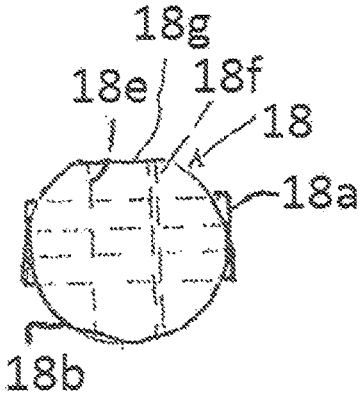
FIG. 6

LIGHTED HANDRAIL ASSEMBLY

This application claims the benefit of U.S. Provisional Application 61/971,611, filed Mar. 28, 2014 and U.S. Provisional Application 61/971,625 filed Mar. 28, 2014.

BACKGROUND OF THE INVENTION

In known wall-protecting handrails, rail members are mounted on brackets in a manner such they can deflect and deform under impacts from objects to prevent damage to the underlying wall. The rail members protect the underlying walls and provide support for persons walking through the building. These handrails are widely used in hospitals and nursing homes, where carts, wheelchairs and the like are moved through hallways and are likely to strike the walls.

Known handrails are supported in spaced-apart relation to the walls to allow space between the handrail and the user's fingers. The supports are individual brackets that are strongly attached to the walls and to the handrails. In some cases a single bolt is used that passes through a hole in a portion of the handrail, a corresponding hole in the bracket, and through the wall. Such a system is disclosed in U.S. Pat. No. 5,288,048.

Another attachment system is disclosed in U.S. Pat. No. 6,508,458.

U.S. Pat. No. 8,210,705 describe an LED lighted hand rail useful in hospitals.

The present inventors have recognized the need for a handrail assembly that provides an efficient and economical system of installing lights onto a handrail.

The present inventors have recognized the need for an efficient and economical method of assembling a handrail with an illumination function.

The present inventors have recognized the need for an illumination system that can be efficiently, effectively and economically applied to handrails, under cabinets, onto hung ceilings and other applications.

The present inventors have recognized the need for a method for economically and effectively producing a cover having an opaque portion and a clear or translucent portion, for use on handrail assemblies or on structures unrelated to handrails.

SUMMARY OF THE INVENTION

Embodiments of the invention provide an illuminated handrail assembly, and a method of installing the assembly, that reduces the installation time for installing handrails, particularly in an institution like a hospital. The embodiments provide a handrail assembly that projects light along the handrail assembly. The exemplary assembly also reduces parts, and the overall cost of the assembly and installation.

A handrail system includes an elongated rail member, wherein the rail member includes a slot for carrying illumination elements, such as LED elements. The LED elements are provided in a light assembly that includes the LED's carried on a printed circuit board that is held by a lens member, the lens member being captured in the rail member slot.

The invention also encompasses a cover for a structure that can be co-extruded to have an opaque portion and a clear or translucent portion. The clear or translucent portion can overlie illumination elements to allow light to pass therethrough. The opaque portion can cover the remainder of the structure, such as a rail member for a handrail.

The invention also encompasses the light assembly comprising the lens member/printed circuit board/LED's and controls for handrails or for other applications. The light assembly could be installed in under cabinet lighting, drop ceiling lighting, and other applications, particularly when the assembly can be fit into a channel that is mounted to structure. The light assembly can be manufactured in preselected lengths, such as one foot lengths to be cost effectively installed along various channels. Multiple preselected lengths (e.g., 4 foot, 3 foot, 1 foot, etc.) of light assemblies can be provided, long and short, to accommodate changes in direction of the channels or channels of variable total length. The light assemblies have connectors to connect adjacent light assemblies to power and/or signals along the length of the application, such as a long rail member.

The invention provides a method of attaching an illuminated handrail to a wall comprising the steps of:

mounting a handrail assembly along a wall;

fitting light assemblies into a slot provided in the handrail, along a length of the handrail, and electrically interconnecting the light assemblies.

The method can further include the step of covering the light assemblies with a clear or translucent cover portion.

The method can further include the step of providing a process for producing the clear or translucent cover portion wherein this portion is co-extruded with an opaque portion, the opaque portion for covering remaining portions of the handrail.

Numerous other advantages and features of the present invention will be become readily apparent from the following detailed description of the invention and the embodiments thereof, and from the accompanying drawings.

BRIEF DESCRIPTION OF THE DRAWINGS

FIG. 5 is an end view taken generally along line 5-5 in FIG. 4;

FIG. 6 is an end view taken generally along line 6-6 in FIG. 4;

DETAILED DESCRIPTION

Figure 1:
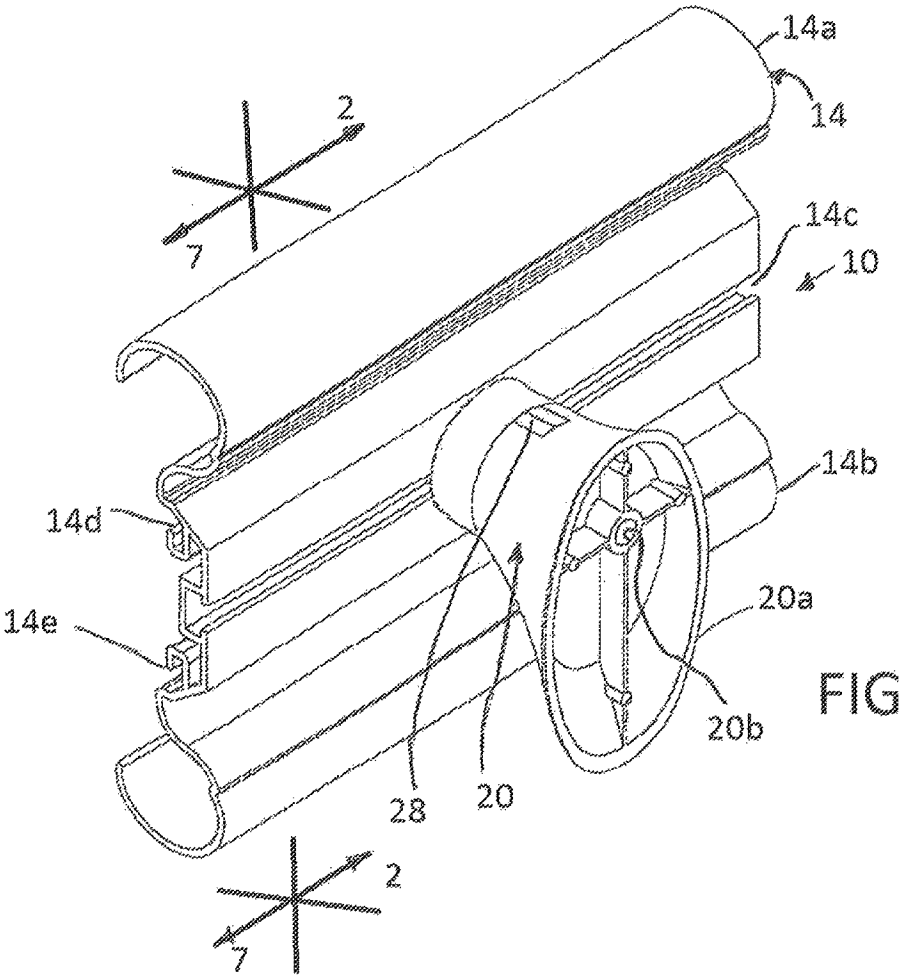
FIG. 1 is a perspective view of a handrail assembly in an assembled state with a front cover and bumper removed to see underlying parts.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

This application incorporates by reference U.S. Ser. No. 14/052,605, filed Oct. 11, 2013 to the extent that it is not inconsistent with the present disclosure. This application incorporates by reference U.S. Provisional Application 61/971,611, filed Mar. 28, 2014 and U.S. Provisional Application 61/971,625, filed Mar. 28, 2014.

FIGS. 1-6 illustrate a handrail assembly 10. The handrail assembly 10 includes an elongated rail member 14, such as an extrusion, an overlying cover 15 and an impact absorber or bumper 16. The elongated rail member includes upper and lower hand-gripping profiles 14*a*, 14*b*, a prone T-shaped slot 14*c* on a back side and bumper assembly slots 14*d*, 14*e* on a front side. The slots 14*c*, 14*d*, 14*e* are formed in a central body 14*f* between the upper and lower hand-gripping profiles. The assembly 10 also includes a plurality of attachment elements 18 carried by the elongated rail member 14 on the back side thereof, a plurality of standoffs or brackets 20, and a plurality of pins 28. Each bracket is attachable at a base end 20*a* to a wall 24 via a threaded fastener 25 through an attachment hole 20*b* in the bracket 20.

Figure 2:
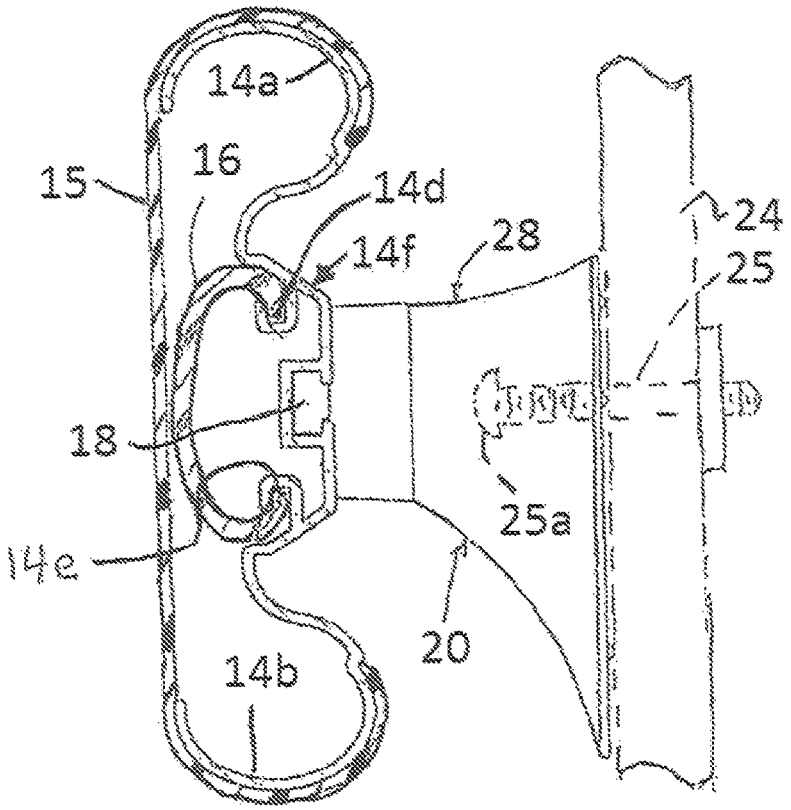
FIG. 2 is a sectional view taken generally along line 2-2 of FIG. 1 with the front cover and bumper installed.

As shown in FIG. 2, the bumper 16 has a generally C-shaped cross-section and edges thereof snap fit into the slots 14*d*, 14*e* to retain the bumper to the rail member 14. The cover 15 has arcuate portions 15*a*, 15*b* that partially surround the hand-gripping formations 14*a*, 14*b* to snap fit the cover 15 onto the rail member 14. The bumper and cover can be installed onto the rail member 14 before the rail member 14 is mounted to the installed brackets 20.

The distal end 20*d* of each of said brackets is an open end and partially receives one of said attachment elements 18 within the open end 20*d*, and one of said pins 28 penetrates through an intermediate portion 20*c* of the bracket 20 and the attachment element 18 to fix the attachment element 18 to the bracket 20.

The bracket 20 includes a first through hole 20*e* and the attachment element 18 includes a second through hole 18*e*, and when the attachment element 18 is inserted sufficiently into the bracket 20, the first and second through holes 20*e*, 18*e* align and the pin 28 is tightly received within both first and second through holes 20*e*, 18*e*.

The pin 28 includes an enlarged head 28*a* and an inclined opposite end 28*b*. The through hole 20*e* is countersunk to accommodate the head flush with the upper contour of the bracket when installed completely. The inclined end 28*b* is shaped to be flush with the lower contour of the bracket when installed completely.

Between the head and the inclined end, on only one side of the pin, is a rib or key 28*c* that tightly fits into a keyway 18*f* in the through hole 18*e* and a keyway 20*f* in the through hole 20*e*. This key and keyway ensures that the pin is properly oriented such that the inclined end terminates flush with the lower contour of the bracket.

The attachment element 18 includes a substantially cylindrical body 18*b* and a prone T-shaped retaining formation 18*a*. The rail member 14 includes the T-shaped slot 14*c* which closely receives the formation 18*a*, slid into the slot 14*c* from an open end of the slot 14*c*. Once installed into the slot, the retaining element 18 can slide longitudinally along the T-shaped slot 14*c* without being separated from the rail member 14.

Preferably, the bracket 20 has a tubular body with the open end 20*d* defining the beginning of a cylindrical void 20*g* which terminates at an end wall 20*i*. The cylindrical void 20*g* is sized to snugly receive the body 18*b* of the element 18. The hole 20*b* is countersunk into the end wall 20*i* to allow for a fastener head 25*a* to be located below the surface of the end wall 20*i* when the bracket is mounted to the wall 24. The void 20*g* has a portion of an inside perimeter defined by a flat surface 20*g*, and the attachment element body 18*b* has a corresponding flat surface 18*g* to be snugly inserted into the void 20*g* and prevented from rotating therein by the flat surfaces 18*g*, 20*g*.

Figure 3:
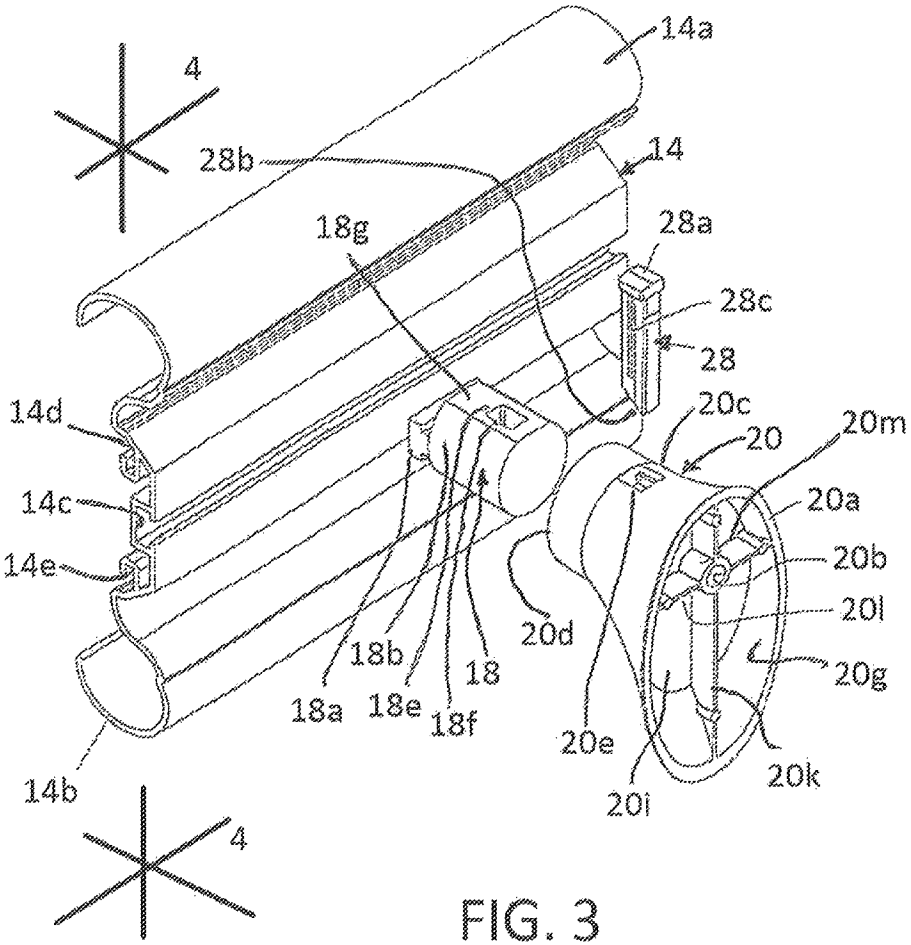
FIG. 3 is a exploded perspective view of the handrail assembly of FIG. 1 in a disassembled state with a front cover and bumper removed to see underlying parts.
Figure 4:
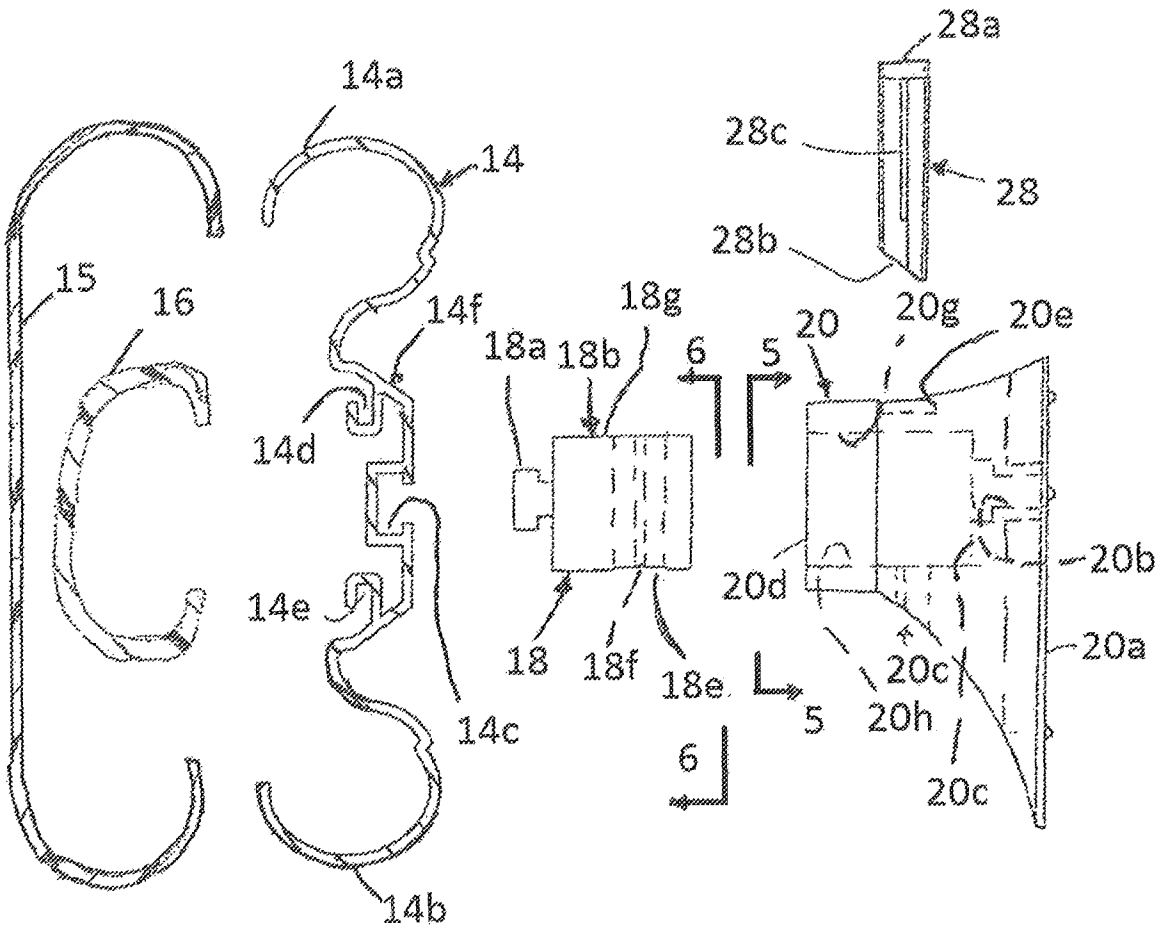
FIG. 4 is a sectional view taken generally along line 4-4 of FIG. 3 with the front cover and bumper included.
Figure 8:
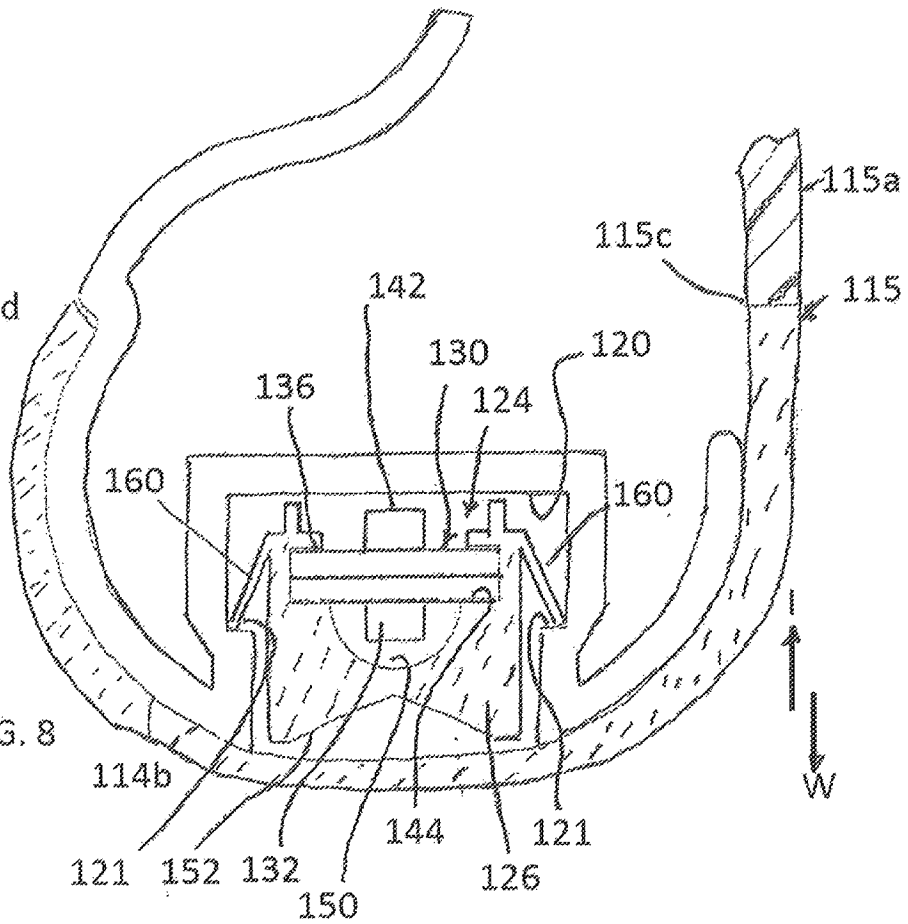
FIG. 8 is an enlarged portion of FIG. 7.
Figure 7:
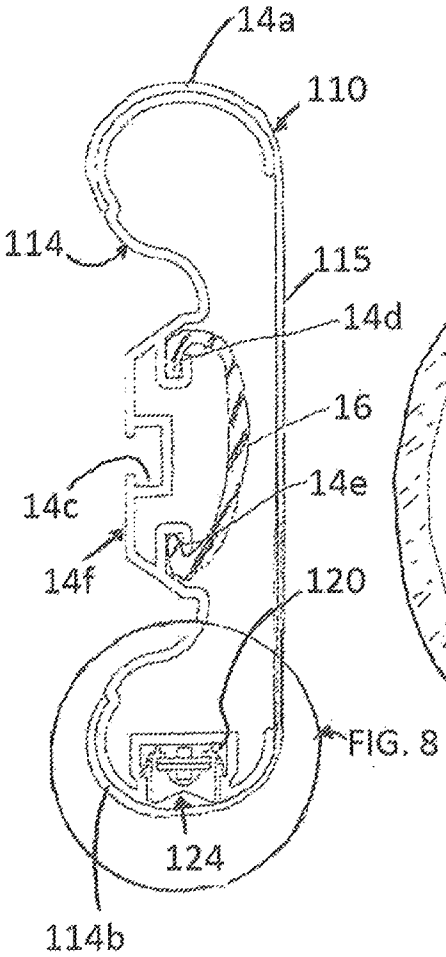
FIG. 7 is a sectional view of an alternate assembly to the embodiment shown in FIGS. 1-6, taken generally along the line 7-7 of FIG. 1 demonstrating an embodiment of the invention.
Figure 9:
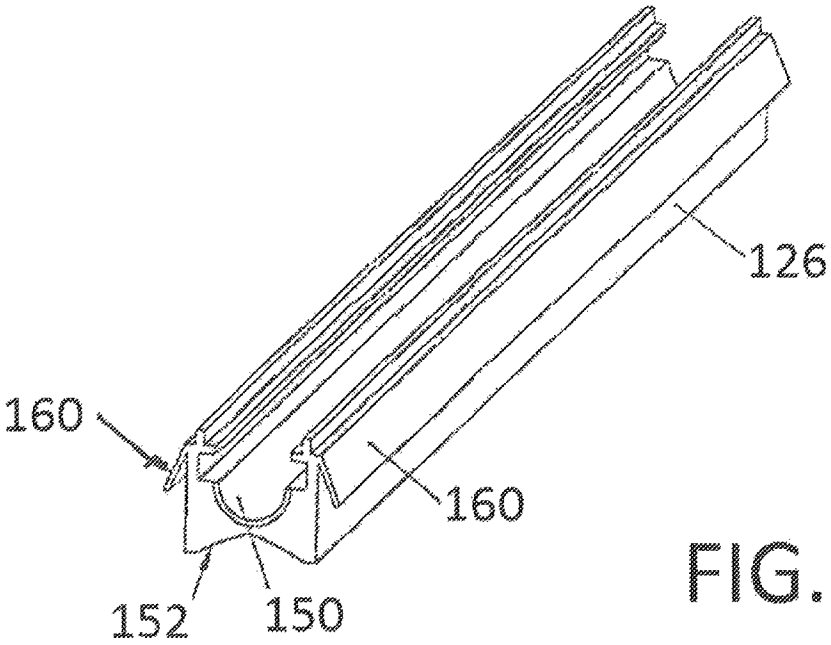
FIG. 9 is a perspective view of a portion of the assembly shown in FIG. 8.
Figure 10:
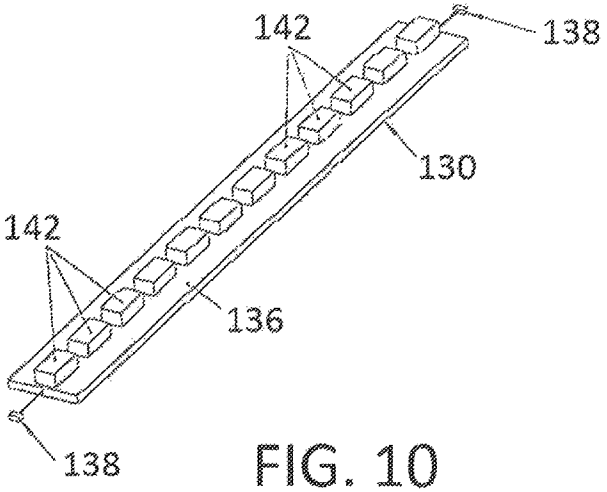
FIG. 10 is a perspective view of another portion of the assembly shown in FIG. 8.

As shown in FIG. 3, the bracket 20 has a surrounding base wall 20*j* at the base end 20*a* that terminates at the end wall 20*i*. A vertical rib 20*k* and a horizontal rib 20*l* intersect at a cylindrical boss 20*m* that surrounds the hole 20*b*. The base wall 20*j*, the ribs 20*k*, 20*l* and the boss 20*m* are formed with the end wall 20*i* and the remainder of the bracket 20.

The rail member 14 can be composed of aluminum 6063. The bracket 20 can be composed of copolyester or ABS. The pin 28 can be composed of copolyester or ABS. The retaining element 18 can be composed of ABS. The cover 15 can be composed of copolyester or PVC and the bumper 16 can be composed of copolyester or PVC. Other materials of construction of these parts are also encompassed by the invention.

The method of attaching the handrail to a wall comprises the steps of:

mounting brackets 20 onto a wall 24, the brackets 20 spaced apart horizontally;

providing that a rail member 14 has a connecting slot 14*c* that slidably receives attachment elements 18 along the slot 14*c*, the slot 14*c* configured to prevent separation of the attachment elements 18 from the rail member 14;

positioning the attaching elements 18 along the slot 14*c* to register with each of the brackets 20 mounted on the wall;

inserting each of the attaching elements 18 into a corresponding bracket 20;

installing through pins 28 which lock each attaching element 18 to the corresponding bracket 20.

FIGS. 7-11 shows an enhanced handrail assembly 110. The assembly 110 is constructed and is assembled the same as the assembly 10 accept as noted. Identical features carry the same reference number.

The assembly 110 includes an elongated rail member 114, such as an extrusion, an overlying cover 115 and an impact absorber or bumper 16. The elongated rail member includes an upper hand-gripping profile 14*a*, a lower profile 114*b*, a prone T-shaped slot 14*c* on a back side and bumper assembly slots 14*d*, 14*e* on a front side. The slots 14*c*, 14*d*, 14*e* are formed in a central body 14*f* between the upper and lower hand-gripping profiles. The assembly 110 also includes the plurality of attachment elements 18 (not shown) carried by the elongated rail member 14 on the back side thereof, the plurality of standoffs or brackets 20 (not shown), and the plurality of pins 28 (not shown) to mount the assembly 110 in the same fashion as the assembly 10.

The lower profile 114*b* is different from the hand-gripping profile 14*b* of the assembly 10 in that a downward facing channel 120 is formed along the length of the member 114. Within the channel 120, a light assembly 124 is captured. The light assembly 124 includes a lens member 126 and an LED assembly 130. The LED assembly 130 includes spaced apart LED's 132 on one side of a printed circuit board (PCB) 136 and corresponding LED drivers 142 shown schematically on the other side of the board. The LED's receive electrical power through conductors in the printed circuit board 136. A connector 138 is provided on each end of the printed circuit board 136 to power and/or signal-connect multiple light assemblies 124 together when arranged end-to-end along the rail member 114. In this regard, the light assemblies 124 can be manufactured in pre-selected lengths (e.g., 6 ft, 4 ft, 1 ft) to allow installation flexibility for rail member changes in direction and to match rail member length with aggregate length of the multiple light assemblies 124 connected together.

The lens member 126 includes a board capture slot 144 for capturing the LED assembly 130, an LED receiving channel 150, and a lens light-directing face 152. The lens member 126 is formed of a clear or translucent material and functions as both a light directing lens but also as a support for the LED's and the PCB for the LED's. The lens member can be an extruded part.

Figure 11:
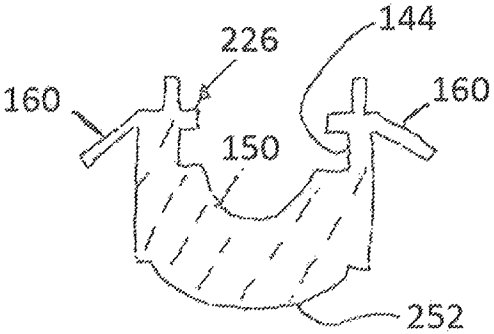
FIG. 11 is a sectional view of an alternate lens member.

The LED receiving channel 150 and/or the light-directing face 152 can be shaped to direct light from the LED's in a chosen direction, e.g., straight down, and/or against the adjacent wall, etc. For example, in FIG. 8, the light-directing face 152 is concave to concentrate the emitted light substantially downward. In FIG. 11, an alternate lens member 226 includes a light-directing face 252 that is convex to spread light widely in a general downward direction. The lens 152, 252 can also be of a material, or treated, or tinted, to achieve the desired LED color, as is known in the art.

The lens member 126 includes extending wings 160 which function as barbs to allow snap fitting of the lens member 126 into the channel 120 along the direction "I" but the wings abut shoulders 121 of the channel 120 to prevent withdrawal in the reverse direction "W". The lens member 126 can be removed from the channel 120 though an open end, by being slid longitudinally (out of the page of FIG. 8).

Although the light assembly 124 is shown and described with respect to a handrail system, the light assembly 124 can also be useful in other applications such as for under cabinet lighting, such as in kitchens, or for drop ceiling tile installations for mounting on the drop ceiling rails, and other installations where elongated light assemblies are desired.

The cover 115 is a co-extruded part having an opaque portion 115*a* extruded with a clear or translucent portion 115*b* along a sharp border 115*c*. The clear or translucent portion allows light to pass from the lens member 126. The clear or translucent portion can be of a material, or treated or tinted, to achieve the desired LED color, as is known in the art. The clear or translucent portion can also be fashioned or shaped as a lens to direct the light from the LED's downward or toward or away from the adjacent wall.

The cover 115 can be co-extruded with different materials for the opaque portion 115*a* and the clear or translucent portion 115*b*, or composed of the same material but with different light transmission. Materials can be for example PETG, polycarbonate, acrylic.

Although the cover 115 is shown and described with respect to a handrail system, the cover 115 can also be useful in other applications where a part opaque/part clear or translucent co-extrusion or co-molding is desired.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A handrail system comprising:

an elongated rail member having a front side and a backside, an upper hand gripping profile and a lower profile;

a light assembly carried on the rail member within a longitudinal slot formed in the rail member lower profile, wherein the light assembly comprises a longitudinal member that can be fit into the longitudinal slot, the longitudinal member having spaced apart light emitting elements over the length of the longitudinal member; and a cover that fits over the rail member, the cover having an opaque portion that extends over the upper hand gripping profile and covers a portion of the front side of the rail member, and a clear or translucent portion that overlies the slot, wherein the opaque portion and the clear or translucent portion are coextruded as one piece.

2. The handrail system according to claim 1, wherein the light assembly longitudinal member comprises LED's carried on a printed circuit board.

3. The handrail system according to claim 2, wherein the light assembly comprises a lens member and the printed circuit board is carried by the lens member and the lens member is captured in the longitudinal slot.

4. The handrail system according to claim 3, wherein the lens member has a clear or translucent body shaped to direct light from the LED's.

5. A cover for a lighted railing structure that has a hand gripping portion and a light-providing portion, comprising: a body having an opaque portion co-extruded along a line with a clear or translucent portion, wherein the opaque portion covers the hand gripping portion and the clear or translucent portion covers the light-providing portion.

6. The cover according to claim 5, wherein the body is shaped to be fit over a rail member of a handrail system, wherein the clear or translucent portion is arranged to overlie the light-providing portion.

7. A light assembly, comprising: a printed circuit board; a plurality of LED's mounted spaced-apart on the printed circuit board, receiving electrical power from conductors of the printed circuit board; a lens member composed of a clear or translucent material, the lens member mounting the printed circuit board and providing a lens function for the light emitted by the LED's; and an electrical connector for providing power to the printed circuit board, wherein the lens member comprises a longitudinal slot and the printed circuit board can be captured into the longitudinal slot to be integrally assembled with the lens for installation as a subassembly.

8. The assembly according to claim 7, further comprising an electrical connector for providing power from the printed circuit board to an adjacent light assembly.

9. The assembly according to claim 7 wherein the light assembly is one of a plurality of light assemblies having at least two pre-selected lengths.

10. The assembly according to claim 7, wherein the lens member has one of a concave lens surface to concentrate light or a convex surface to spread light, from the LED's.

11. The assembly according to claim 10, wherein the lens member is shaped to be captured into a slot in a channel member.

12. The assembly according to claim 11 wherein the lens member comprises wings that act as barbs to retain the lens member into the slot in the channel member.

13. The assembly according to claim 11 wherein the channel member is formed on an elongated rail member of a handrail system.

14. A handrail system comprising:

an elongated rail member providing a longitudinal slot;

a light assembly carried on the rail member within the longitudinal slot, wherein the light assembly comprises a longitudinal member having spaced apart light emitting elements over the length of the longitudinal member, and an elongated lens member having a lengthwise slot therein for capturing the longitudinal member, wherein the lens member is sized and shaped to be fit, along with the captured longitudinal member, into the longitudinal slot of the rail member, the lens member directing light from the light emitting elements out of the longitudinal slot.

15. The handrail system according to claim 14, further comprising:

a cover that fits over the rail member, the cover having an opaque portion that extends over an upper portion of the rail member and a clear or translucent portion that overlies the slot, wherein the opaque portion and the clear or translucent portion are coextruded as one piece.

16. The handrail system according to claim 14, wherein the light assembly longitudinal member comprises LED's carried on a printed circuit board.

17. The handrail system according to claim 16, further comprising an electrical connector for providing power from the printed circuit board to an adjacent light assembly.

18. The handrail system according to claim 14, wherein the lens member has one of a concave lens surface to concentrate light, or a convex surface to spread light, from the light emitting elements.

19. The handrail system according to claim 14, wherein the longitudinal slot comprises shoulders and the lens member comprises wings that act as barbs to abut the shoulders to retain the lens member in the longitudinal slot in the rail member.

* * * * *